United States Patent [19]

Newsome et al.

[11] 4,386,550

[45] Jun. 7, 1983

[54] OPTICALLY COUPLED DECORATIVE LIGHT CONTROLLER

[75] Inventors: Michael R. Newsome, Falls Church, Va.; Marc H. Segan; Sayre Swarztrauber, both of New York, N.Y.

[73] Assignee: Calfax, Inc., New York, N.Y.

[21] Appl. No.: 185,680

[22] Filed: Sep. 10, 1980

[51] Int. Cl.[3] ..... G10H 1/02

[52] U.S. Cl. ..... 84/464 R; 84/1.24

[58] Field of Search ..... 84/464, 1.03, 1.19, 84/1.24; 250/551; 307/252 B; 315/156, 157

[56] References Cited

U.S. PATENT DOCUMENTS

| | | | |
|---|---|---|---|
| 3,518,486 | 6/1970 | Babcock | 315/194 |
| 3,598,889 | 8/1971 | Switsen | 84/464 |
| 3,818,235 | 6/1974 | Johnson et al. | 250/551 |
| 3,878,750 | 4/1975 | Kapps | 84/1.01 |
| 4,014,167 | 3/1977 | Hasegawa et al. | 84/1.03 X |
| 4,090,107 | 5/1978 | Seib | 315/156 |
| 4,110,750 | 8/1978 | Heyning et al. | 84/1.01 |
| 4,159,442 | 6/1979 | Komatsu | 315/156 |
| 4,176,288 | 11/1979 | Komatsu et al. | 307/252 A |
| 4,205,574 | 6/1980 | Hoskinson et al. | 84/1.19 |
| 4,223,582 | 9/1980 | Kato et al. | 84/1.19 |
| 4,236,437 | 12/1980 | Howell et al. | 84/1.19 |
| 4,265,159 | 5/1981 | Liebman et al. | 84/464 R |

OTHER PUBLICATIONS

Sourcebook of Electronic Circuits, 1968, pp. 401–402.

Blechman, "Transistor-Photocell Color Organ", Electronics World, Jul. 1964, vol. 72, No. 1.

*Primary Examiner*—J. V. Truhe

*Assistant Examiner*—Forester W. Isen

*Attorney, Agent, or Firm*—Pennie & Edmonds

[57] ABSTRACT

A digital rectangular wave musical tone generator (10) activates a speaker (12) to produce sounds of aural quality similar to musical instruments, while varying the intensity of light output from a light-emitting diode (13). The intensity variations of this light controls the resistance of a photoresistor (16), which varies the power supplied to decorative lights by a power control device (19), thus varying the intensity of the decorative lights in synchronism with the sound.

11 Claims, 2 Drawing Figures

OPTICALLY COUPLED DECORATIVE LIGHT CONTROLLER

TECHNICAL FIELD

This invention relates to an apparatus for controlling the intensity of decorative lights in response to an electronically generated series of musical tones, and in particular to an optically coupled means for controlling a semiconductor power control device.

BACKGROUND ART

In recent years, it has become common practice to enhance the sensual effects of various kinds of music by modulating the intensity of various light sources located in the listening area in response to the sound level of the music.

One method for accomplishing this result uses acoustical pick up devices to change the sound into electrical impulses which then control various types of power control devices that in turn vary the level of power applied to a light source. This approach has the disadvantage of allowing any sound, even an undesired noise, to vary the light output unless sophisticated circuitry designed to provide noise immunity or to respond to signals only above a predetermined intensity level is utilized.

In addition, in setting up such a system to provide a sound/light program it is necessary to provide a source of music such as a conventional analog electromechanical sound reproduction device, for example a phonograph or tape recorder, or as an alternative, a live performance by one or more musicians. Signals broadcast from commercial broadcasting stations may of course also be used, but then it is generally not possible to have control of the program, which is based on the discretion of the broadcaster. A further difficulty is that the volume level of the sound may not be adjusted without having an effect on the intensity of the light source.

Another method uses the analog electrical audio signal output of a sound reproduction means to control the power control device that in turn varies the power level to the light source. While this avoids the problem of extraneous noises influencing light intensity, the other disadvantages mentioned above still remain.

DISCLOSURE OF THE INVENTION

The present invention uses an electronic music bell tone generator to produce the desired sound rather than conventional electromechanical, analog sound reproduction means such as a phonograph or tape recorder.

It further provides means for controlling the intensity of decorative lighting in response to the musical tones produced by using an optical coupler driven by the electronic bell tone generator.

It also provides a means for varying the volume of the sound produced without affecting variations of the decorative lights, because the optical coupler's response is not varied by adjustment of the power supplied to an acoustic transducer.

BRIEF DESCRIPTION OF THE DRAWING

The invention is described with reference to the annexed drawings, in which.

DESCRIPTION OF THE PREFERRED EMBODIMENT

Figure 1:
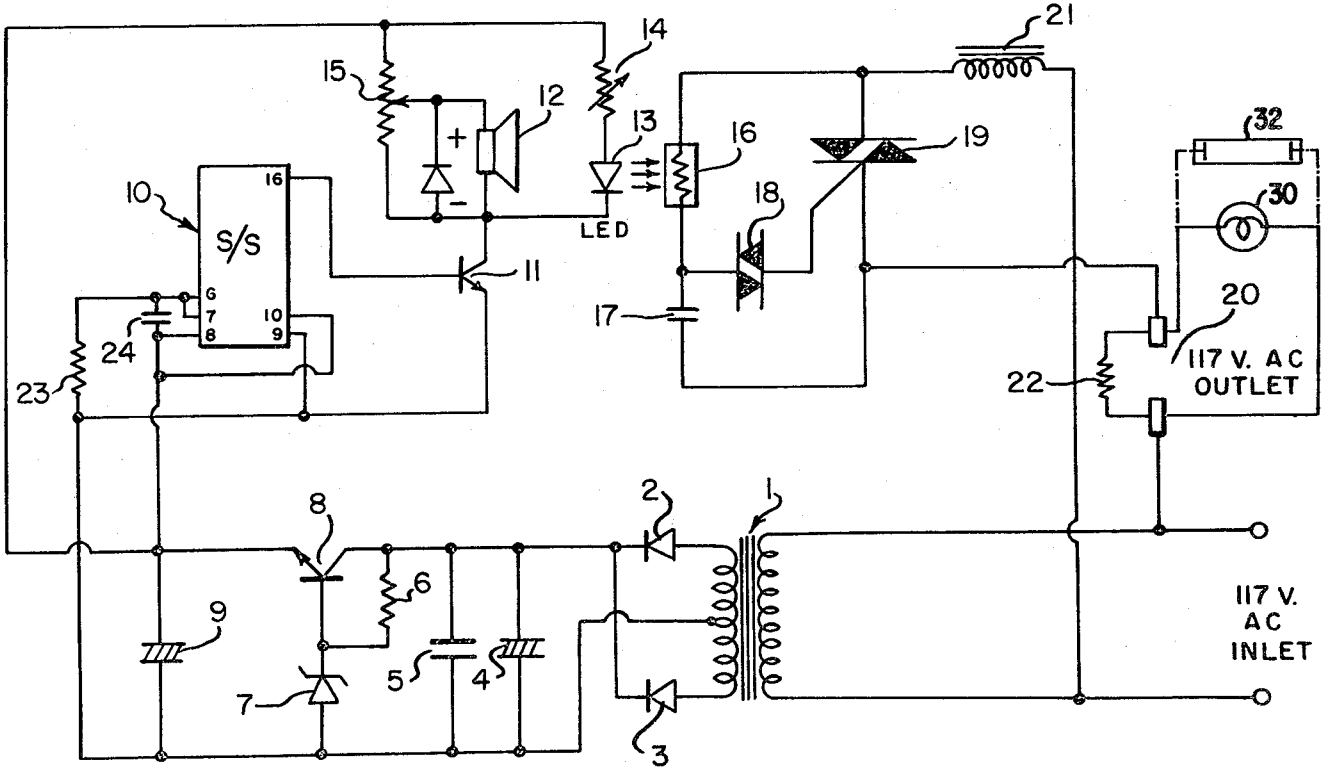
FIG. 1 is a schematic diagram of the preferred embodiment of the invention.

Referring to FIG. 1, a transformer 1, powered by a 117 volt a.c. line supplies approximately 8.2 VAC to diodes 2 and 3, which provide a rectified output that is filtered by capacitors 4 and 5. The resulting DC output is regulated at 6 VDC by a regulator circuit comprised of resistor 6, Zener diode 7, and transistor 8. The output of the regulator is further filtered by capacitor 9 and is applied to custom integrated circuit 10, which in combination with its associated components, resistor 23 and capacitor 24, is designed to provide a series of rectangular waves of varying energy content. These rectangular waves comprise a signal which alternates between two voltage levels. This custom integrated circuit comprises memory means for storing values defining period and duration of the musical tones, and control means comprised of logic and arithmetic means which access the memory means, thus generating a series of rectangular waves for each tone by controlling the time at which the signal changes between two voltage levels. Each wave in the series has a predetermined energy content so that the intensity of each musical tone is varied over its duration. For a discussion of the details of operation of this device, see copending application Ser. No. 117,799 for Audio Visual Message Device filed Feb. 1, 1980 by Sayre Swarztrauber et al., which describes the custom integrated circuit 10 that generates a series of rectangular waves which drive an acoustic transducer means such as a speaker and produces a series of musical tones which have the aural characteristics of tuned bells. This device is designed to repetitively play approximately eleven different Christmas songs. It is also described in more detail below.

The rectangular wave output of integrated circuit 10 is connected to the base of amplifying transistor 11. The collector of amplifying transistor 11 supplies current to an electroacoustic transducer, preferably a speaker 12 in response to these rectangular waves. The speaker 12, may be located within the same housing as the remainder of the circuit described herein, or may be located externally and connected to the circuit by suitable electrical conductors. The diode 25 connected across the speaker 12 protects the amplifying transistor from damage caused by voltages induced in the speaker 12 in response to sudden changes in the current through the speaker 12. Potentiometer 15 is used to control the current through the speaker 12 thus varying the intensity of sound from the speaker 12. As described in copending application Ser. No. 000,268, now U.S. Pat. No. 4,250,787, for Music Tone Generator, filed Feb. 1, 1979 by Sayne Swarztrauber et al. the speaker 12 or other similar sound reproducing means may be unresponsive to harmonics of the fundamental frequency of the wave applied, and will thus generate relatively pure tones.

The output of amplifying transistor 11 also activates light emitting diode 13, through variable resistor 14. The intensity of light emitting diode 13 is controlled by variable resistor 14. This adjustment is set at the time of the manufacture as is indicated below and is not normally disturbed thereafter.

The resistance values of potentiometers 14 and 15 are chosen so that adjustment of the sound intensity by varying the setting of potentiometer 15 has negligible effect on the light intensity of the light emitting diode 13.

The response time of light emitting diode 13 is such that the light produced faithfully follows the rectangular waves generated by the integrated circuit 10. This light falls upon the active surface of photoresistor 16, causing its resistance to vary in essentially the same manner. Both light emitting diode 13 and photoresistor 16 are isolated from all external light sources by mounting within an opaque housing, not shown, and are mechanically arranged so that the light output of light emitting diode 13 falls upon the active, light sensing, surface of photoresistor 16.

Photoresistor 16 is part of a triac control circuit comprised of capacitor 17, diac 18, triac 19, and inductor 21, which controls the power supplied from a 117 volt alternating current line source to outlet 20, where a light source, not shown, is connected. When a light source is connected to the outlet 20, the line voltage appears across the series combination of the photoresistor 16 and the capacitor 17. On any given half cycle of the line voltage the triac 19 is initially off. If a musical tone is being sounded, the capacitor 17 is charged, in steps, during the individual cycles of the rectangular wave, which occur at a frequency much greater than the frequency of the line voltage.

The voltage across the capacitor 17 thus is an integration of the series of rectangular pulses of the musical tones. On cycles of the line voltage during which the voltage across the capacitor 17 reaches the breakover voltage of diac 18, a predetermined level, a pulse of current is conducted through the diac 18 to the gate of the triac 19, turning on the triac 19. Line current is then conducted through the main terminals of the triac 19 and through the inductor 21 to a load attached to the outlet 20. Conduction continues for the remainder of the half cycle of the line voltage, ceasing when the current in the load goes to zero at the end of that half cycle. During subsequent half cycles of the line voltage, the above sequence of events is repeated. The observer of a light source connected to the outlet 20 perceives a variation in the intensity of the light in synchronism with the sounding of the musical tones. Thus, the triac control circuit is similar in operation to a conventional light dimmer circuit using conduction phase control modified in that the photoresistor 16 is used instead of a potentiometer and there is an integration of the series of rectangular pulses by capacitor 17.

The light source connected to the outlet 20 is preferably an incandescent lamp 30 or a series of incandescent lamps, as for instance Christmas tree lights or Christmas decorations. It may be desired, however, to control a different type of light source such as a gas discharge tube 32. If this light source, or its associated circuit components, present an essentially open circuit, it will be necessary to provide a resistor 22 electrically connected across the outlet 20, to complete the series circuit also comprised of photoresistor 16 and capacitor 17, thus permitting charging of capacitor 17. Suitable starter circuitry for a gas discharge tube would also have to be provided, and inductor 21 would then be chosen to have a value compatable with operation of such a light source, when connected to the outlet 20.

The potentiometer 14 is set to produce a desired variation of the intensity of the light source connected to outlet 20 for the particular output level of the amplifying transistor 11. For example, a setting which results in the light being totally off during any time interval between tones may be desired, or partial illumination may be produced, at such times, by a different setting.

In addition or alternatively, light emitting diode 13 and photoresistor 16, while mechanically arranged so that the light output of light emitting diode 13 falls upon the active, light sensing surface of photoresistor 16, may be located within a housing, not shown, which allows a small percentage of ambient light not produced by the light source connected to the outlet 20 to fall upon the photoresistor 16. This will allow the user to adjust the background or resting light intensely (that is the intensity of the light source connected to the outlet 20 during a time interval when no tone is sounded) by partially or completely blocking the ambient light reaching the photoresistor 16 with an opaque object.

As will be obvious to one skilled in the art, an additional advantage of the use of light emitting diode 13 and photoresistor 16 is excellent electrical isolation between the triac power control circuit and the music tone generator circuit, both described above.

Figure 2:
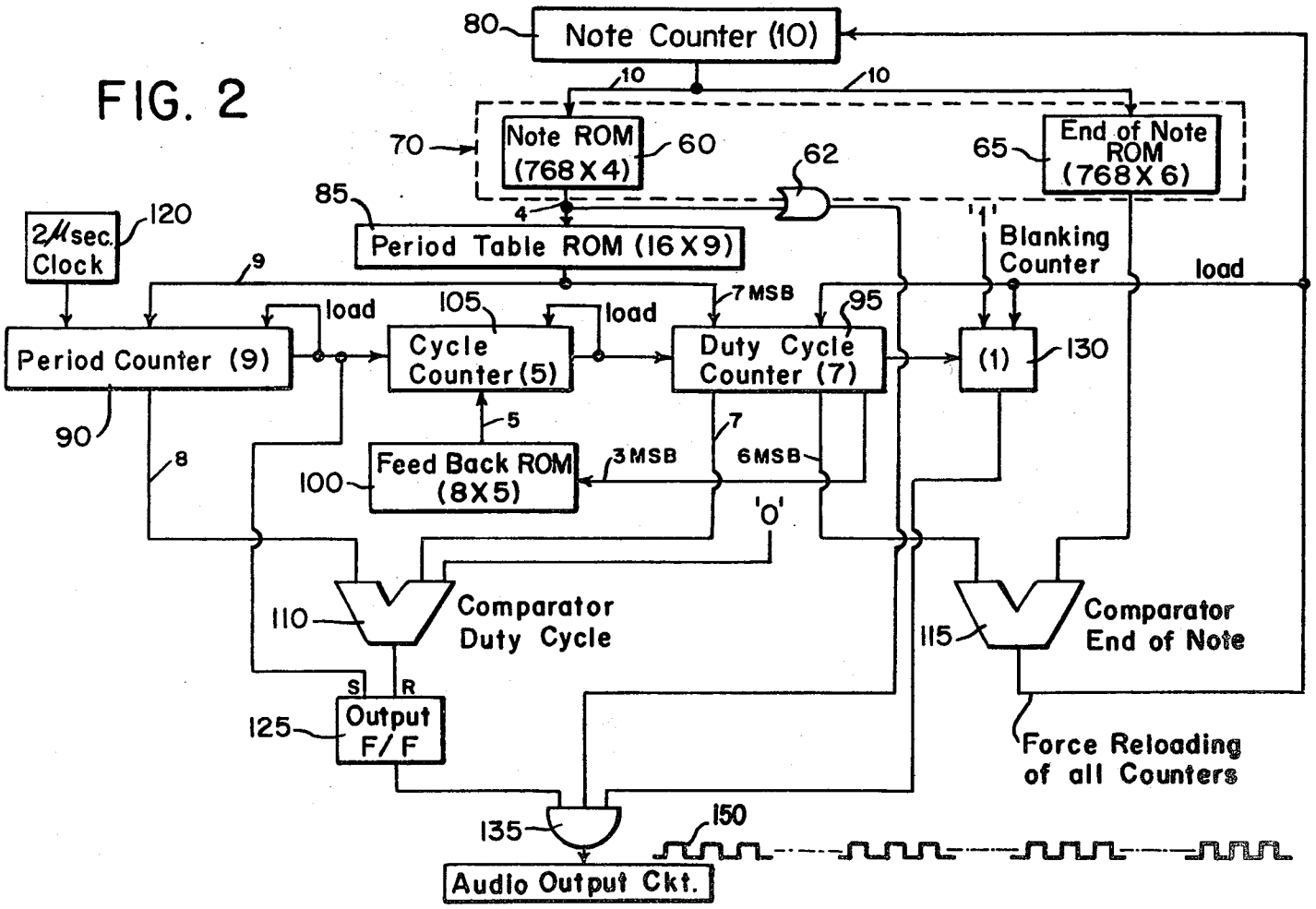
FIG. 2 is a block diagram of the integrated circuit bell tone generator used in the device of the invention.

FIG. 2 is a functional block diagram of the digital electronic integrated circuit music tone generator which produces the waveforms of the audio signal generated by the device of the invention. It is understood that the actual integrated circuit comprises hundreds of digital logic elements fabricated on a single silicon chip using available integrated circuit technology. The integrated circuit chip of the illustrative embodiment was manufactured using such technology by LSI Computer Systems, Inc. of Melville, N.Y. This circuit uses the principles set forth in co-pending application Ser. No. 000,268, now U.S. Pat. No. 4,250,787 and is in fact an integrated circuit embodiment of the programmed micro-processor of that invention.

Referring to FIG. 2 there is shown a Note Read Only Memory (hereinafter a Note ROM) 60 which is 768 by 4 bits and an End of Note ROM 65 which is 768 by 6 bits. In the actual construction of the integrated circuit they constitute a single 768 by 10 bit memory, indicated by dashed line 70. In other words, a single 768 by 10 bit digital memory is fabricated on the chip; the four least significant bits RO0–RO3 of each word identify the note to be sounded and the six most significant bits RO4–RO9 of each word determine the duration of that note. The 768 words are arranged in the ROM so that when they are addressed by 10 bit Note Counter (CTR) 80 each note of a musical composition is played in succession. In this embodiment the notes of eleven different Christmas carols are so arranged. Table I lists the contents of the Note and End of Note ROM in coded form. The actual bit pattern of each word in the ROM can be decoded using Table II to decode the six most significant bits and Table III to decode the four least significant bits. The 3 digit column headings are the address of the first entry in each column which addresses are also in the code shown in Table III. This address corresponds to the value in the Note Counter 80 which contains the ten least significant bits of this twelve bit address code. Thus, as is more fully explained below each word is accessed sequentially by incrementing the Note Counter 80.

The NOTE information contained in the four least significant bits of each word in the Note and End of Note ROM is used as a four bit address for accessing the period values stored in the Period Table ROM 85. There are sixteen 9 bit values stored in this ROM which define the period or frequency of each of the 15 notes and one rest used in the musical compositions to be played. The rest is provided when the four address bits are zero by OR gate 62 which disables AND gate 135. Table IV contains the sixteen 9 bit values stored in the period Table ROM 85.

The 9 bit period values from Table IV the Period Table ROM are loaded into the Period Counter 90 which is a nine stage modulo n down counter that is part of the digital logic used to fix the period of the series of rectangular waves generated to sound the particular note to which that period corresponds, as will be more fully explained herein below.

The 7 Most Significant Bits (MSB) of the 9 bit period values are loaded into the Duty Cycle Counter 95 which is a seven stage modulo n down counter that along with Feedback ROM 100, Cycle Counter 105 and Duty Cycle Comparator 110 forms a part of the digital logic that determines the duty cycle or energy content of the rectangular waves in the series generated to sound the particular note as represented by waveform 150. The 6 MSB's of the Duty Cycle Counter 95 are also used in conjunction with End of Note Comparator 115 to determine when the note has come to an end and the next note is to be selected and played.

As can be seen the Period Counter is driven by a 2 microsecond clock 120. There is of course a source of voltage and current (not shown) to power this clock as well as the other functions depicted in FIG. 2 as will be understood by those skilled in the art.

Finally, the actual series of rectangular waves is formed by the setting and resetting of Output Flip/Flop 125, (F/F), the output of which is anded with the output of Blanking Counter 130 by And gate 135 and fed to the audio output circuit.

The operation of each of the digital logic elements shown in FIG. 2 will be illustrated by explaining the generation of the rectangular wave series for the first note stored in the Note and End of Note ROM 70. Upon application of power to the integrated circuit Note Counter 80 is set to its initial value of all zeros. Referring to Table I it is seen that the address 000 contains the value E for the Note and the value 33 for the Duration or End of Note. By reference to Tables II and III it can be seen that this represents the ten digit number 0011001110. As was stated above the four least significant bits RO0–RO3 (1110) are used as an address to the Period Table ROM 85. Referring to Table IV it is seen that the 9 bit number 101010101 is stored at this address. Thus this number is loaded into the nine stages of the Period Counter 90 as is indicated by the 9 on the line from the Period Table ROM 85. Simultaneously the 7 MSB's of this number 1010101 are loaded into the seven stages of the Duty Cycle Counter 95 as is indicated by the 7 on the line from the Period Table ROM 85. The 3 MSB's of this number (101) are in turn used as an address for the Feedback ROM 100 as is indicated by the 3 on the line from the Duty Cycle Counter 95. Referring to Table V it is seen that the five digit number 00001 is stored at this address and it is loaded into the five stages of the Cycle Counter 105 as is indicated by the 5 on the line from the Feedback ROM 100.

As is indicated by the 8 on the line from Period Counter 90 the 8 MSB's of that counter are compared to the 7 bits in the Duty Cycle Counter 95, shifted by a constant '0' bit, in the Duty Cycle Comparator 110. This shift is accomplished by placing a '0' in the most significant bit which in effect divides the number represented by the 8 MSB's in half providing a 50% duty cycle. In operation the Output Flip/Flop 125 is set upon loading of the Period Counter 90 and is reset by an output from the Duty Cycle Comparator 110. The Period Counter 90 continues to count down to the end of the period and upon underflow is reloaded with the value in the Period Table 85. Simultaneously, the Output Flip/Flop 125 is set and the Cycle Counter 105 is decremented. This process continues until the number of rectangular waves equal to the number stored in the Cycle Counter have been generated. It is noted that each of these waves has the same duty cycle or energy content. When the Cycle Counter 105 underflows it is reloaded with the value in the Feedback ROM 100. Simultaneously, the Duty Cycle Counter 95 is decremented and a new duty cycle or energy content is determined for the rectangular wave. This process continues until there is an output from the End of Note Comparator 115 which is comparing the 6 MSB's of the Duty Cycle Counter 95 with the 6 bits stored in the End of Note ROM 65. This output causes incrementing of the Note Counter 80 as well as forces the loading of all of the other counters so that the above described process can be commenced for the next Note. It will be recognized by those skilled in the art that there is "pipelining" involved in the timing of these events. In the event the Duty Cycle Counter 95 reaches zero without having caused an End of Note output from comparator 115, the next input to the Duty Cycle Counter from the Cycle Counter will cause it to underflow, which in turn causes the Blanking Counter 130 to go to zero and disable the AND gate 135. This in turn prevents any further output of rectangular waves to the audio output circuit. In this instance the Duty Cycle Counter will begin counting down from its maximum value until an output is generated from the Comparator 115 and a new note is selected as is described herein above.

The foregoing is a detailed description of the specific embodiment of the audio generating digital memory and digital logic used in the optically coupled decorative lighting controller of the invention. It is recognized that other arrangements of digital memory and logic can be employed to achieve the objects of the invention, for example the programmed microprocessor of copending application Ser. No. 000,268, now U.S. Pat. No. 4,250,787, could be used. In addition, it is well within the skill of the art to alter the memory and energy content controlling logic of this embodiment to obtain different musical messages and to produce sounds other than bell tones.

Various modifications of the invention in addition to that shown and described herein will become apparent to those skilled in the art from the foregoing description and accompanying drawings. Such modifications are intended to fall within the scope of the appended claims.

TABLE I

CODED NOTE-DURATION TABLE (768 × 10)

| 000 | | 020 | | 040 | | 060 | |
|---|---|---|---|---|---|---|---|
| NOTE | DUR | NOTE | DUR | NOTE | DUR | NOTE | DUR |
| E | 33 | E | 2F | D | 00 | 6 | 38 |
| A | 37 | 7 | 37 | D | 31 | 7 | 37 |
| A | 21 | 9 | 35 | D | 31 | 7 | 37 |
| 9 | 32 | A | 33 | 6 | 38 | 7 | 31 |
| A | 21 | E | 3E | 7 | 37 | 7 | 31 |
| B | 30 | E | 28 | 9 | 35 | 7 | 37 |
| D | 34 | E | 28 | 4 | 3B | 9 | 35 |
| D | 34 | E | 2F | 4 | 3B | 9 | 35 |
| D | 34 | 7 | 37 | 4 | 3B | 7 | 37 |
| 9 | 34 | 9 | 35 | 4 | 3B | 9 | 00 |

TABLE I-continued

| | | | | | | | |
|---|---|---|---|---|---|---|---|
| 9 | 32 | A | 33 | 2 | 3E | 4 | 09 |
| 7 | 34 | D | 08 | 4 | 3B | 7 | 37 |
| 9 | 32 | D | 31 | 6 | 38 | 7 | 37 |
| A | 31 | 6 | 38 | 9 | 35 | 7 | 03 |
| B | 36 | 7 | 37 | A | 3C | 7 | 37 |
| E | 33 | 9 | 35 | 4 | 109 | 7 | 37 |
| E | 33 | B | 0D | 7 | 37 | 7 | 03 |
| 7 | 3C | 4 | 3B | 7 | 37 | 7 | 37 |
| 7 | 34 | 4 | 3B | 7 | 03 | 4 | 3B |
| 6 | 35 | 6 | 38 | 7 | 37 | A | 38 |
| 7 | 34 | 9 | 35 | 7 | 37 | 9 | 30 |
| 9 | 32 | 7 | 03 | 7 | 03 | 7 | 03 |
| A | 37 | 0 | 09 | 7 | 37 | 0 | 09 |
| D | 34 | E | 2F | 4 | 3B | 6 | 38 |
| E | 2C | 7 | 37 | A | 38 | 6 | 38 |
| E | 2C | 9 | 35 | 9 | 30 | 6 | 3E |
| D | 34 | A | 33 | 7 | 03 | 6 | 32 |
| 9 | 34 | E | 05 | 0 | 09 | 6 | 38 |
| B | 36 | E | 2F | 6 | 38 | 7 | 37 |
| A | 05 | 7 | 37 | 6 | 38 | 7 | 37 |
| 0 | 31 | 9 | 35 | 6 | 3E | 7 | 31 |
| 0 | 31 | A | 33 | 6 | 32 | 7 | 31 |

| 030 | | 0A0 | | 0C0 | | 0E0 | |
|---|---|---|---|---|---|---|---|
| NOTE | DUR | NOTE | DUR | NOTE | DUR | NOTE | DUR |
| 4 | 3B | 9 | 3E | C | 3B | 6 | 36 |
| 4 | 3B | A | 04 | E | 3A | 6 | 3B |
| 6 | 3B | 9 | 35 | F | 07 | 8 | 2F |
| 9 | 3A | A | 3B | 0 | 31 | 9 | 33 |
| A | 0F | D | 06 | 0 | 31 | 9 | 33 |
| 0 | 31 | 0 | 09 | 1 | 0A | 9 | 33 |
| 0 | 31 | 9 | 08 | 2 | 02 | 9 | 33 |
| A | 04 | 0 | 04 | 4 | 33 | 9 | 33 |
| 9 | 35 | 9 | 3E | 6 | 0A | 9 | 2E |
| A | 3B | 6 | 0F | 8 | 34 | 8 | 2F |
| D | 06 | 7 | 36 | 9 | 3C | 6 | 0A |
| 0 | 09 | 9 | 3E | A | 39 | 8 | 2F |
| A | 04 | A | 04 | C | 3E | 9 | 2E |
| 9 | 35 | 9 | 35 | 6 | 36 | A | 31 |
| A | 3B | A | 3B | 4 | 0F | A | 31 |
| D | 06 | D | 06 | 4 | 38 | A | 31 |
| C | 09 | 0 | 09 | 2 | 2B | A | 2B |
| 4 | 07 | 4 | 07 | 2 | 3B | 9 | 2E |
| 0 | 09 | 0 | 09 | 1 | 1B | 8 | 06 |
| 4 | 07 | 4 | 07 | 0 | 1D | 9 | 2E |
| 7 | 0D | 1 | 9E | 1 | 3C | A | 2B |
| 0 | 0D | 0 | 04 | 1 | 3C | C | 30 |
| 6 | 03 | A | 3A | 2 | 3B | 1 | 0A |
| 0 | 09 | 7 | 02 | 4 | 38 | 4 | 38 |
| 6 | 03 | 6 | 0F | 6 | 36 | 6 | 3B |
| A | 0D | 0 | 0D | 6 | 3B | 8 | 2F |
| 0 | 09 | 2 | 0C | 8 | 2F | 9 | 33 |
| 9 | 08 | 0 | 20 | 9 | 33 | 8 | 34 |
| 0 | 04 | 6 | 05 | 1 | 3C | 9 | 3C |
| 9 | 3E | A | 3D | 1 | 3C | A | 39 |
| 6 | 0F | D | 3A | 2 | 3B | C | 0A |
| 7 | 36 | A | 3E | 4 | 38 | 0 | 31 |

| 100 | | 120 | | 140 | | 160 | |
|---|---|---|---|---|---|---|---|
| NOTE | DUR | NOTE | DUR | NOTE | DUR | NOTE | DUR |
| 0 | 31 | 0 | 08 | 6 | 06 | C | 30 |
| A | 3B | 7 | 01 | 7 | 04 | A | 2C |
| A | 0C | 0 | 08 | 0 | 0A | 9 | 2F |
| E | 35 | 9 | 3E | 9 | 1B | 8 | 30 |
| A | 3B | 7 | 01 | A | 36 | A | 2C |
| 9 | 1B | A | 3B | A | 03 | 9 | 38 |
| E | 02 | 9 | 3E | 0 | 31 | A | 2C |
| 7 | 01 | B | 01 | 0 | 31 | C | 30 |
| 9 | 3E | D | 30 | 6 | 3C | D | 30 |
| 7 | 01 | E | 35 | 8 | 30 | C | 38 |
| 6 | 02 | A | 3B | 9 | 34 | A | 36 |
| 7 | 0B | A | 3B | A | 32 | 9 | 2F |
| 0 | 04 | B | 39 | C | 30 | 8 | 35 |
| 9 | 3E | A | 3B | A | 32 | A | 32 |
| A | 3B | 9 | 3E | 9 | 34 | 9 | 38 |
| A | 0C | A | 0C | C | 30 | 8 | 30 |
| B | 39 | E | 35 | A | 2C | 6 | 36 |
| D | 37 | 7 | 01 | 9 | 2F | A | 32 |
| B | 39 | 7 | 01 | 8 | 30 | 9 | 2F |
| A | 3B | 9 | 3E | A | 2C | 7 | 30 |
| 9 | 3E | 7 | 01 | 9 | 38 | 6 | 36 |
| 7 | 01 | 6 | 02 | A | 2C | 4 | 33 |

TABLE I-continued

| | | | | | | | |
|---|---|---|---|---|---|---|---|
| B | 09 | 7 | 01 | C | 30 | 2 | 35 |
| D | 3E | 0 | 08 | D | 30 | 1 | 3D |
| E | 2E | 9 | 3E | C | 38 | 2 | 3C |
| E | 02 | 7 | 01 | 6 | 3C | 4 | 39 |
| 0 | 1C | 6 | 02 | 8 | 30 | 6 | 01 |
| 4 | 06 | 7 | 01 | 9 | 34 | 6 | 3C |
| 0 | 08 | 9 | 3E | A | 32 | 8 | 30 |
| 6 | 02 | A | 3B | C | 30 | 9 | 34 |
| 7 | 01 | B | 0C | A | 32 | A | 32 |
| 6 | 02 | A | 3C | 9 | 34 | C | 30 |

| 180 | | 1A0 | | 1C0 | | 1E0 | |
|---|---|---|---|---|---|---|---|
| NOTE | DUR | NOTE | DUR | NOTE | DUR | NOTE | DUR |
| A | 32 | A | 3E | A | 2E | 7 | 3A |
| 9 | 34 | 9 | 01 | A | 3E | 7 | 3A |
| C | 32 | 7 | 3F | 9 | 01 | 9 | 37 |
| 4 | 34 | 7 | 32 | 7 | 3F | A | 35 |
| 4 | 34 | 7 | 22 | 7 | 32 | B | 34 |
| 4 | 34 | 7 | 38 | 7 | 22 | D | 32 |
| 4 | 34 | 9 | 36 | 7 | 38 | E | 31 |
| 6 | 05 | 7 | 38 | 9 | 36 | D | 32 |
| 8 | 33 | 6 | 07 | 7 | 38 | B | 34 |
| 9 | 3E | B | 3D | 6 | 09 | A | 35 |
| A | 3D | 9 | 01 | B | 00 | 9 | 37 |
| C | 07 | A | 3E | 9 | 06 | 7 | 08 |
| 0 | 31 | 4 | 0B | A | 02 | 0 | 05 |
| 0 | 31 | 4 | 3C | 0 | 31 | 7 | 3A |
| E | 38 | 7 | 38 | 0 | 31 | 6 | 3B |
| A | 39 | 2 | 1A | D | 32 | 9 | 37 |
| A | 2E | 0 | 05 | D | 32 | 7 | 3A |
| A | 3E | 4 | 3C | 7 | 3A | 6 | 3B |
| 9 | 01 | 4 | 3C | 7 | 3A | 4 | 3E |
| 7 | 3F | 6 | 39 | 9 | 37 | 2 | 01 |
| 7 | 32 | 6 | 07 | A | 35 | 7 | 3A |
| 7 | 22 | 6 | 07 | B | 34 | 9 | 37 |
| 7 | 38 | 6 | 39 | D | 32 | A | 35 |
| 9 | 36 | 9 | 36 | E | 31 | D | 32 |
| 7 | 38 | 4 | 0B | D | 32 | B | 34 |
| 6 | 07 | 0 | 05 | B | 34 | A | 35 |
| B | 3D | 6 | 39 | A | 35 | 9 | 04 |
| 9 | 01 | 6 | 39 | 9 | 37 | A | 35 |
| A | 3E | 7 | 38 | 7 | 08 | 9 | 37 |
| E | 38 | 7 | 05 | 0 | 05 | 7 | 08 |
| A | 39 | E | 38 | D | 32 | 6 | 3B |
| A | 2E | A | 39 | D | 32 | 7 | 3A |

| 200 | | 220 | | 240 | | 260 | |
|---|---|---|---|---|---|---|---|
| NOTE | DUR | NOTE | DUR | NOTE | DUR | NOTE | DUR |
| 7 | 3A | 0 | 0D | 7 | 3C | 0 | 31 |
| 9 | 37 | 0 | 07 | 6 | 35 | E | 33 |
| A | 35 | E | 33 | 7 | 34 | A | 38 |
| B | 34 | E | 33 | 9 | 3A | A | 3F |
| D | 3C | D | 34 | A | 05 | B | 30 |
| A | 2F | B | 36 | 7 | 34 | A | 38 |
| B | 2E | B | 36 | 9 | 32 | 7 | 3D |
| D | 32 | B | 36 | A | 37 | 7 | 3D |
| 9 | 04 | B | 36 | B | 03 | 9 | 3B |
| A | 35 | A | 31 | 9 | 32 | 4 | 02 |
| 9 | 37 | B | 30 | A | 31 | 4 | 02 |
| 7 | 3A | A | 37 | B | 36 | 4 | 0D |
| 6 | 3B | B | 03 | D | 00 | 6 | 35 |
| 4 | 3E | 0 | 0D | 0 | 0D | 7 | 3D |
| 2 | 01 | 0 | 07 | 0 | 33 | 9 | 3B |
| 7 | 3A | D | 34 | E | 07 | 7 | 0F |
| 9 | 38 | B | 36 | D | 34 | E | 33 |
| A | 36 | A | 37 | B | 36 | A | 38 |
| B | 35 | 9 | 3A | B | 36 | A | 3F |
| D | 3E | 9 | 3A | B | 36 | B | 30 |
| 0 | 31 | 9 | 3A | B | 36 | A | 38 |
| 0 | 31 | 7 | 3C | A | 31 | 7 | 3D |
| E | 07 | 9 | 32 | B | 30 | 7 | 3D |
| D | 34 | A | 31 | A | 37 | 9 | 3B |
| B | 36 | B | 36 | B | 03 | 4 | 02 |
| B | 36 | D | 0B | 0 | 0D | 9 | 3B |
| B | 36 | D | 34 | 0 | 0D | 9 | 03 |
| B | 36 | B | 36 | D | 2E | B | 30 |
| A | 31 | A | 37 | E | 2C | B | 37 |
| B | 30 | 9 | 3A | D | 34 | D | 35 |
| A | 37 | 9 | 3A | E | 07 | E | 3E |
| B | 03 | 9 | 3A | 0 | 31 | 4 | 02 |

| 280 | | 2A0 | | 2C0 | | 2E0 | |
|---|---|---|---|---|---|---|---|

TABLE I-continued

| NOTE | DUR | NOTE | DUR | NOTE | DUR | NOTE | DUR |
|---|---|---|---|---|---|---|---|
| 4 | 02 | 2 | 06 | 4 | 01 | 7 | 3C |
| 4 | 02 | 4 | 02 | 4 | 0B | 6 | 3E |
| A | 38 | 6 | 3F | 6 | 35 | 7 | 0D |
| 6 | 3F | 7 | 3D | 7 | 0D | 9 | 09 |
| 7 | 3D | 6 | 22 | 7 | 3C | 4 | 01 |
| 7 | 3D | 9 | 3B | 9 | 3A | 0 | 06 |
| 9 | 3B | 7 | 34 | 7 | 3C | 2 | 3A |
| 4 | 02 | 6 | 35 | 4 | 01 | 4 | 37 |
| 4 | 02 | 4 | 1E | 7 | 05 | 6 | 35 |
| 4 | 02 | A | 32 | 9 | 32 | 7 | 34 |
| A | 38 | A | 3D | A | 05 | 6 | 10 |
| 6 | 3F | 9 | 00 | 4 | 01 | 4 | 37 |
| 7 | 3D | A | 12 | 0 | 06 | 6 | 35 |
| 7 | 3D | 0 | 31 | 2 | 3A | 7 | 34 |
| 9 | 3B | 0 | 31 | 4 | 37 | 9 | 32 |
| 2 | 06 | 7 | 3C | 6 | 35 | 7 | 0D |
| 2 | 06 | 7 | 3C | 7 | 34 | 6 | 35 |
| 2 | 06 | 7 | 3C | 6 | 10 | 7 | 34 |
| 4 | 02 | 4 | 01 | 4 | 37 | 9 | 32 |
| 6 | 3F | 4 | 0B | 6 | 35 | A | 30 |
| 7 | 3D | 6 | 35 | 7 | 34 | 9 | 01 |
| 6 | 22 | 7 | 0D | 9 | 32 | E | 2B |
| 9 | 3B | 7 | 3C | 7 | 0D | E | 3D |
| 7 | 34 | 9 | 3A | 6 | 35 | A | 37 |
| 6 | 36 | 7 | 3C | 7 | 34 | 9 | 3A |
| 4 | 0D | 4 | 01 | 9 | 32 | 7 | 3E |
| A | 31 | 7 | 05 | A | 30 | 6 | 3E |
| A | 38 | 9 | 32 | 9 | 01 | 7 | 21 |
| 9 | 3B | A | 05 | E | 2B | 9 | 19 |
| 7 | 0F | 7 | 3C | E | 3D | A | 05 |
| 2 | 24 | 7 | 3C | A | 37 | 0 | 31 |
| 2 | 3A | 7 | 3C | 9 | 3A | 0 | 31 |

TABLE II

| 6 Bit Conversion Chart | | | |
|---|---|---|---|
| 00 | 111111 | 20 | 011111 |
| 01 | 111110 | 21 | 011110 |
| 02 | 111101 | 22 | 011101 |
| 03 | 111100 | 23 | 011100 |
| 04 | 111011 | 24 | 011011 |
| 05 | 111010 | 25 | 011010 |
| 06 | 111001 | 26 | 011001 |
| 07 | 111000 | 27 | 011000 |
| 08 | 110111 | 28 | 010111 |
| 09 | 110110 | 29 | 010110 |
| 0A | 110101 | 2A | 010101 |
| 0B | 110100 | 2B | 010100 |
| 0C | 110011 | 2C | 010011 |
| 0D | 110010 | 2D | 010010 |
| 0E | 110001 | 2E | 010001 |
| 0F | 110000 | 2F | 010000 |
| 10 | 101111 | 30 | 001111 |
| 11 | 101110 | 31 | 001110 |
| 12 | 101101 | 32 | 001101 |
| 13 | 101100 | 33 | 001100 |
| 14 | 101011 | 34 | 001011 |
| 15 | 101010 | 35 | 001010 |
| 16 | 101001 | 36 | 001001 |
| 17 | 101000 | 37 | 001000 |
| 18 | 100111 | 38 | 000111 |
| 19 | 100110 | 39 | 000110 |
| 1A | 100101 | 3A | 000101 |
| 1B | 100100 | 3B | 000100 |
| 1C | 100011 | 3C | 000011 |
| 1D | 100010 | 3D | 000010 |
| 1E | 100001 | 3E | 000001 |
| 1F | 100000 | 3F | 000000 |

TABLE III

| A Bit Conversion Chart | |
|---|---|
| CODE | DATA |
| 0 | 1000 |
| 1 | 0001 |
| 2 | 0010 |
| 3 | 0011 |

TABLE III-continued

| A Bit Conversion Chart | |
|---|---|
| CODE | DATA |
| 4 | 0100 |
| 5 | 0101 |
| 6 | 0110 |
| 7 | 0111 |
| 8 | 1000 |
| 9 | 1001 |
| A | 1010 |
| B | 1011 |
| C | 1100 |
| D | 1101 |
| E | 1110 |
| F | 1111 |

TABLE IV

| | Period Table ROM | |
|---|---|---|
| NOTE | Address | Period |
| 0 | 0000 | 111111110 |
| 1 | 0001 | 010001111 |
| 2 | 0010 | 010010111 |
| 3 | 0011 | 010100000 |
| 4 | 0100 | 010101010 |
| 5 | 0101 | 010110100 |
| 6 | 0110 | 010111111 |
| 7 | 0111 | 011001010 |
| 8 | 1000 | 011010111 |
| 9 | 1001 | 011100011 |
| A | 1010 | 011111111 |
| B | 1011 | 100001111 |
| C | 1100 | 100011111 |
| D | 1101 | 100110000 |
| E | 1110 | 101010101 |
| F | 1111 | 101111111 |

TABLE V

| Feedback ROM (8 × 5) | |
|---|---|
| Address | Data |
| 000 | 11111 |
| 001 | 11111 |
| 010 | 01111 |
| 011 | 00111 |
| 101 | 00001 |
| 100 | 00011 |
| 110 | 11111 |
| 111 | 11111 |

We claim:

1. An apparatus for controlling power, in synchronism with the sounding of musical tones, from a power source supplied to an output terminal to which a light source is connected, comprising:

(a) at least one means for producing sound;

(b) means for producing an electrical signal;

(c) control means associated with said electrical signal producing means for controlling the signal so as to produce musical tone waveforms of predetermined frequency;

(d) means for transmitting said musical tone waveforms to said means for producing sound;

(e) means for transmitting said musical tone waveforms to light emitting means for producing light having an intensity varying at the frequency of the musical tone waveforms;

(f) power control means for controlling power from said power source supplied to said output terminal;

(g) light detector means for receiving light from said light emitting means, said light detector means varying in resistance at said frequency of said musical tone waveform in response to said light produced by said light emitting means;

(h) means for integrating a current generated in response to said varying resistance to produce a voltage; and (i) means for activating said power control means when said voltage reaches a predetermined level during each half cycle of the power source whereby power is supplied to said light source so as to vary its intensity in response to said musical tone waveform and in synchronism with musical tones produced by said means for producing sound.

2. The apparatus of claim 1 wherein the control means associated with said electrical signal producing means produces tones having predetermined intensity and duration by controlling the time at which said signal changes between two voltage levels, said changes being selected to provide a predetermined energy content of each period of the fundamental frequency of each tone so as to vary the intensity of each tone over its duration.

3. The apparatus of claim 1 wherein said control means comprise a single integrated circuit.

4. The apparatus of claim 1 further comprising means for varying the amplitude of the electrical signal conducted to said electro-acoustic transducer independently of the amplitude of the electrical signal to which the light emitting means responds.

5. The apparatus of claim 1 wherein the light emitting means is a light emitting diode.

6. The apparatus of claim 1 wherein the light detector means is a photoresistor.

7. The apparatus of claim 1 wherein the power control means is a triac.

8. The apparatus of claim 1 wherein the musical tones comprise a series of notes of Christmas songs.

9. The apparatus of claim 1 wherein the light source comprises a gas discharge tube.

10. The apparatus of claim 1 wherein the light source is comprised of incandescent lamps.

11. The apparatus of claim 10 wherein the incandescent lamps comprise Christmas decorations.

* * * * *